United States Patent [19]

De Torre

[11] 3,932,825

[45] Jan. 13, 1976

[54] CURRENT LIMITING CIRCUIT BREAKER SYSTEM

[75] Inventor: John De Torre, Albemarlel, N.C.

[73] Assignee: Federal Pacific Electric Company, Newark, N.J.

[22] Filed: Apr. 9, 1974

[21] Appl. No.: 459,321

[52] U.S. Cl. ..... 335/8; 335/10; 317/119

[51] Int. Cl.[2] ..... H01H 77/02

[58] Field of Search ..... 335/6, 8, 9, 10, 11, 19; 200/296; 317/119

[56] References Cited

UNITED STATES PATENTS

| | | | |
|---|---|---|---|
| 3,187,147 | 6/1965 | Dietz et al. | 317/119 X |
| 3,218,519 | 11/1965 | Casey | 317/119 |
| 3,333,157 | 7/1967 | Stokes | 317/119 |
| 3,349,290 | 10/1967 | Casey | 317/119 |
| 3,573,415 | 4/1971 | Gryctko | 317/119 X |
| 3,745,415 | 7/1973 | Polley et al. | 317/119 X |

*Primary Examiner*—G. Harris

[57] ABSTRACT

Circuit-breaker system having a response time to shortcircuits of less than 4 milliseconds have multiple coordinated pole units wired in series in each phase. The system is able to clear a fault where the available current is high, for example 100,000 amperes at 240 volts AC although each pole unit may be of conventional construction having a current-interruption rating of only 5 or 10 thousand amperes. The operation exhibits current limiting properties, and the interruption process leaves the pole units remarkably free of arc damage.

15 Claims, 17 Drawing Figures

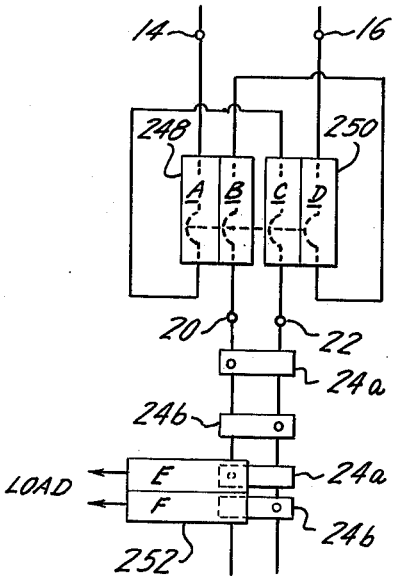
FIG. 10
FIG. 11A
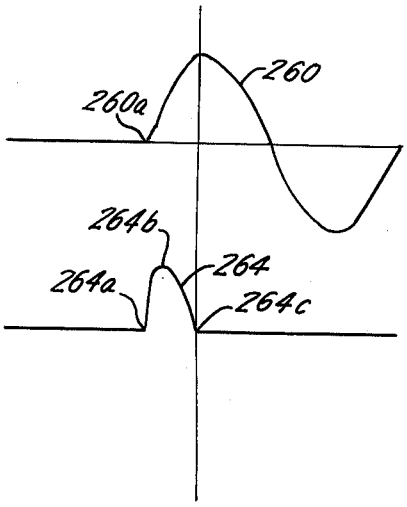
FIG. 11B
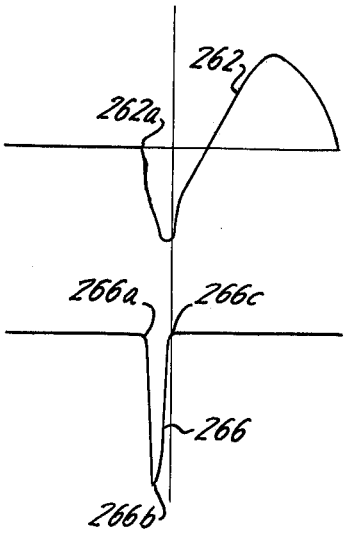

CURRENT LIMITING CIRCUIT BREAKER SYSTEM

FIELD OF THE INVENTION

The present invention relates to molded-case circuit breakers and to circuit-breaker panels, including so-called panelboards and load centers.

BACKGROUND OF THE INVENTION

Two-pole circuit breakers used with individual loads or as the main of so-called "panels" (panelboards and load centers) commonly have a 5 or 10,000 ampere current-interruption rating at 240 volts AC. However, the available current from a single phase 240 volt AC source is often greatly in excess of 10,000 amperes, often five or ten times as much.

Fuses have recently come into use as the "main" protective device or interrupter for panels of residential-class circuit breakers energized by AC lines having high levels of available current. However, unlike circuit breakers, fuses have the usual disadvantages that they must be replaced when blown, and they cannot be operated like a switch to turn the power service on and off. This practice is illogical, but it has been adopted for lack of molded-case circuit breakers of reasonable proportions having high current-interrupting capacity. Conventional circuit breakers have been used for years as the main breaker of a panel even in installations where the available current exceeds the interruption capacity of the breaker; but in that case, a much larger circuit breaker upstream in the distribution system is actually relied on for clearing extreme faults in the panel.

A molded-case circuit breaker of the so-called quick-lag type is available having a 75,000 Amp interruption rating. That particular circuit breaker (in common with the usual molded-case circuit breakers rated at 5,000 or 10,000 Amp interrupting capacity) dependes for arc-interruption upon the AC voltage crossing zero after the incidence of a short-circuit. Moreover, the current through such circuit breakers tends to rise to approximately the same peak level that would occur were the breaker to remain closed after incidence of the fault. Consequently, a very high level of arcing energy develops in such breakers when interrupting short circuits. Relatively severe arcing damage to the contacts and in and near the arc chute results in such circuit breakers. Special high-strength molded cases are required. Seemingly, they depend upon electrodynamic effects in the particular configuration of the current path through the conductive parts identified with the contacts for promoting contact-opening operation. Such high values of electrodynamic contact-opening force is not available for short circuits substantially below the 75,000 Amp rating of such circuit breakers. Whether for this reason or becuase of the severe arcing damage that must occur during severe short circuits, these circuit breakers have apparently attained only limited acceptance.

The circuit breakers involved here are known as molded-case in the industry. The operating mechanism and the arc chambers are enclosed in cases of molded insulation. The arcs that develop after the contacts open under short circuit conditions are interrupted in the air of the arc chambers. Low voltage breakers of the so-called "air breaker" class are far too bulky and expensive for purposes of the present invention. Parenthetically, even such air breakers generally have inferior current-interruption capacities, compared to that which can be attained pursuant to the invention.

SUMMARY OF THE INVENTION

In the novel circuit breaker system as applied to a singlephase source, plural coordinated individual "pole units" are connected in a series configuration between a corresponding load terminal and each side of a 240 volt 60 hertz source having a high value of available current, e.g. 100,000 amperes. The pole units have a response time of the order of one-fourth cycle at 60 hertz between the incidence of a severe overcurrent and operation of the contacts to full open position. The coordination of the pole units provides essentially simultaneous operation. Pole units of conventional construction may be used, even though the interrupting capacity of two such pole units when connected to a 240-volt single-phase AC source may be no more than 5 or 10,000 amperes of available current.

The term pole unit is used herein to designate a set of contacts including moving and companion contacts, means enclosing the set of contacts for providing space for arcing upon separation of the contacts, and a component part of the contact operating mechanism which carries a moving one of said set of contacts. Each series configuration of pole units with its overcurrent-responsive device or devices constitutes a "pole" of the novel circuit breaker system.

The term "coordinated" is used herein to designate either the truly concurrent or the nearly simultaneous release of the companion pole units of a circuit breaker system or, more briefly, an "interrupter", upon the release of one of the pole units of the interrupter. Truly concurrent release occurs when the over-current sensing devices of the poles of an interrupter are arranged to activate a single release mechanism for all the pole units of the interrupter. Nearly simultaneous release occurs when the over-current sensing device of each pole of the interrupter or each pole unit causes the release of its associated series configuration and of the companion series configuration of pole units. In the latter case, the opening of that associated pole unit causes the opening of the companion pole units.

In the novel circuit breaker system, a series configuration and essentially simultaneous operation of these fast acting pole units is capable of driving the available current to zero without depending on the voltage reaching zero. Such a coordinated series configuration of breaker units also serves to limit the peak current flowing through the pole units to a level that is much lower than that which would flow with the circuit breaker units restrained in their closed condition. Thus, the amount of arcing energy in each pole unit that is generated between the times of contact separation and arc extinction is greatly reduced, and correspondingly the arcing damage to the contacts and the arcing chamber is minimized.

A particular configuration of the novel circuit breaker system for single-phase power service utilizes two commerically standard 3-pole circuit breakers. Each 3-pole breaker has a common tripping mechanism. If an over-current detector associated with one of the pole units in one 3-pole breaker detects an overcurrent condition, all three pole units are tripped. A pair of the pole units in each 3-pole breaker and the third pole unit of the other circuit breaker are connected in series between each of two line conductors and each of the two load terminals. One pole unit (or both pole units) of each said pair and said third pole unit in series therewith have overcurrent tripping means, and all 3 pole units of each 3-pole circuit breaker are cross-coupled for coordinated essentially simultaneous release.

Another configuration of the novel circuit breaker system utilizes three standard 2-pole circuit breakers, with 1 pole of each of the three breakers connected in series between each line conductor and the load side of the system. The pole units of each 2-pole breaker are cross-coupled for coordinated essentially simultaneous tripping, and each pole unit includes overcurrent response means.

In either of the above configurations, a fault would cause all 6 pole units to open, clearing the line of the fault. A still further configuration of the novel circuit breaker system utilizes a single breaker of 6 pole units, 3 of the pole units connected in series between each line conductor and each of the two load terminals of the system. All 6 pole units are coordinated for essentially simultaneous tripping.

Any of the breaker configurations described above may be used alone to protect the supply against faults. In particular, any of the foregoing breaker configurations may serve as the main interrupter of a panelboard or load center. When used as part of a panelboard or load center, the main interrupter is connected between the line conductors and the panel bus assembly to which the branch circuit-breakers are connected. Standard residential-class breakers of the usual 5,000 Amp or 10.000 Amp interruption capacity may be used as branch breakers, and yet the coordinated pole units of the system are effective to clear faults in the panel or at the branch circuits, in cases where the available current is considerably higher than the interruption capacity of the branch circuit breakers.

In each case, it is desirable yet not essential for the manual operating handles of the pole units forming the main interrupter to be connected together, both for common manual opening and closing, and for greater assurance that all of the pole units will open when any pole unit opens in response to an overcurrent.

In each of the examples above, two sets of three pole units are coordinated and connected in series to serve as the interrupter for clearing even severe faults of a single-phase supply, including line-to-neutral and line-to-line faults, where the line has a particularly high level of available current. Those standard pole units have the requisite fast response time, but as made commercially, their arc chutes have no ferrous arc splitter plates. Other forms of commercial pole units have a substantial assembly of arc-quenching splitter plates. When such pole units are used, two series-connected pole units (rather than three) may suffice between each line terminal of the supply and a corresponding load terminal. Where two standard 2-pole circuit breakers of that type are used, having pole units coupled in pairs for coordinated tripping, they lack mechanical means for coupling all pole units together for common tripping. As in the other examples above involving plural multi pole breakers, one pole unit of each multi pole breaker and 1 pole unit of the other multi pole breaker are connected in series between each line terminal and each load terminal, respectively.

The novel circuit breaker system may utilize two standard 2-pole circuit breakers as the main circuit interrupter of a panel. As before, the series connection berween each line conductor and the panel bus includes one pole unit of each breaker. A branch breaker acts as a third pole between the line conductor and the fault where the fault occurs at the load side of the branch circuit breaker. Except for particular forms of 2-pole circuit breakers, such a configuration would not satisfy specifications requiring protection evan as against short circuits in the panel bus.

The novel circuit breaker system is discussed herein for simplicity as applied to a single-phase supply, but it will be apparent that it is readily adaptable for three-phase protection.

DETAILED DESCRIPTION

In the drawings:

FIGS. 8, 9 and 10 are various additional configurations of pole units useful as the main interrupter of the panel illustrated in FIG. 1.

FIG. 11A and 11B is a series of oscillogram traces representing the performance of the panel illustrated in FIG. 10;

Figure 1:
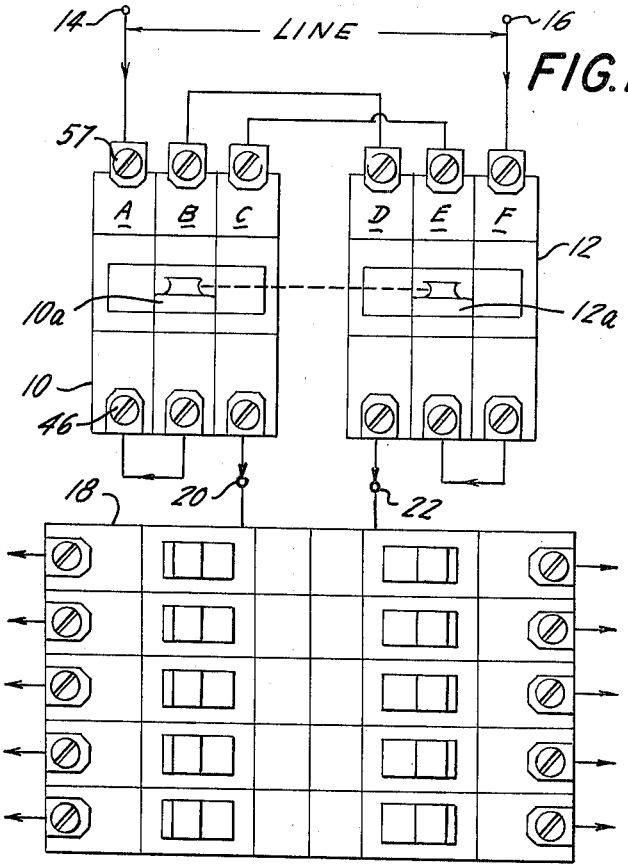
FIG. 1 is a diagrammatic view of a circuit breaker panel including main and branch circuit breakers.

Referring now to the drawings, two circuit breakers 10 and 12 are shown in FIG. 1. Each of these circuit breakers is a 3-pole circuit breaker so that circuit breaker 10 includes pole units 10A, 10B and 10C, and circuit breaker 12 includes pole units 12D, 12E and 12F. Alternating current supply terminals 14 and 16 are here assumed to provide 240 volts, single phase, and to have an available current greatly in excess of 10,000 amperes, 100,000 amperes as an example. In FIG. 1, circuit breaker 10 has three upper terminals and three lower terminals, and the same is true of circuit breaker 12. In the normal application of such three-pole circuit breakers, the upper terminals in the drawing might be called "line" terminals and the lower terminals might be called "load" terminals. However, here the designation "first" and "second" terminals are used to refer to the aligned terminals shown at the top and at the bottom of each circuit breaker in FIG. 1. Line terminal 14 is connected to the first terminal of pole unit 10A; the second terminals of pole units 10A and 10B are connected together, the first terminal of pole unit 10B is connected to the first terminal of pole unit 12D and the second terminal of pole unit 12D is connected to one terminal 22 of the panel bus assembly (or "bus") 24 of FIG. 2 to which the branch circuit breakers 18 are connected. Correspondingly, alternating current supply terminal 16 is connected to the first terminal of pole unit 12F, the second terminals of pole units 12E and 12F are connected together, and the first terminal of pole unit 12E is connected to the first terminal of pole unit 10C whose second terminal is connected to another terminal 20 of the panel bus 24. Two rows of circuit breakers 18 (FIG. 1) are assembled to the bus (FIG. 2) for energization by the second terminals of pole units 10C and 12D. Circuit breakers 18 provide branch-circuit protection. The bus is sequence-phased as usual, so that either single-pole circuit breakers or 2-pole circuit breakers may be used in such a panel, as required by the nature of the branch circuits involved.

The several pole units of circuit breakers 10 and 12 are arranged in a kind of symmetry such that alternating current supply terminals 14 and 16 are connected to the outermost pole units, physically, of circuit breaker 10 and 12, whereas the connections from those circuit breakers to the panel bus extend from the second terminals of the innermost pole units 10C and 12D. Other interconnections of similar nature, will be apparent for aligning the load terminals of the main interrupter with the main bus terminals.

Notably, there are 3 pole units 10A, 10B and 12D connected in series between alternating current supply terminal 14 and terminal 22 of the panel bus, and correspondingly, there are three pole units 12F, 12E and 10C connected in series between alternating current supply terminal 16 and the other terminal 20 of the panel bus.

In operation it may be imagined that a short circuit develops between bus terminal 20 and neutral or "ground" (since the neutral is grounded) or between bus terminals 20 and 22. In the case of a line-to-ground short circuit, the available current from the line at half of the line voltage, is safely interrupted by three series-connected circuit breaker pole units in their open condition. In the case of a line-to-line short circuit between bus terminals 20 and 22, there are 6 circuit breaker pole units in their open condition connected in series for interrupting the fault at full line voltage.

Pole units 10A, 10B and 10C are mechanically coupled to each other for coordinated tripping. In one kind of circuit breaker that is commonly available, each pole unit when tripped as a result of an overload sensing device within the breaker, releases its own mechanism to cause parting operation of the contacts and the initial part of such contact-opening operation activates a trip bar which mechanically trips the companion poles of that three-pole circuit breaker. In other types of commonly available three-pole circuit breakers, sensing of an overload condition in one or more of the poles results in a common trip bar releasing the common operating mechanism of the individual contact-operating mechanisms of the three pole units of that circuit breaker, for what may be more precisely called simultaneous release. In both kinds of circuit breakers, the pole units operate essentially simultaneously in response to an overcurrent. Both types of circuit breakers are referred to conveniently as having common release. Both types of circuit breakers also have common manual means including handles 10a and 12a for operating breakers 10 and 12 into their "open" and "closed" conditions.

Figure 8:
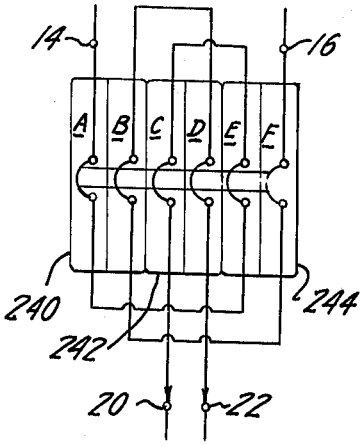

As an alternate embodiment to that shown in FIG. 1 instead of two 3-pole circuit breakers, the main interruption of the panel could consist of three 2-pole circuit breakers, as for example breakers, 240, 242, and 244 (FIG. 8). It is to be noted that the interruption includes 6 pole units, 240A, 240B, 242C, 242D, 244E, 244F having their operating handles tied together, and that the pole units are series connected in two sets of three pole units in each set. The first terminals of pole units 240B and 242D are connected together, the first terminals of pole units 242C and 244E are connected together, the second terminals of pole units 240B and 244F are connected together, the second terminals of pole units 240A and 244E are connected together. As before, the two outermost first terminals 240A and 244F are connected to the line alternating current supply terminals 14 and 16, while the two innermost second terminals are connected to the bus terminals 20 and 22. As before, a fault across bus terminals 20 and 22, or between either bus terminal and neutral causes all 6 pole units to open, clearing the circuit.

Figure 9:
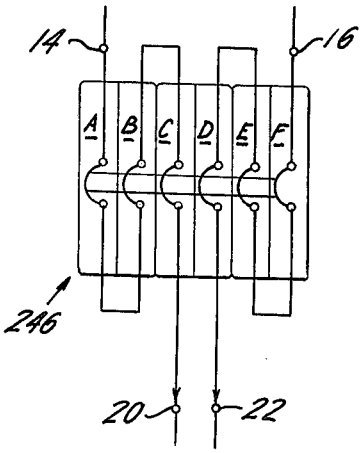

A still further alternate embodiment to the two breakers 10 and 12 schematically illustrated in FIG. 1 is a single six pole breaker 246 shown in FIG. 9. Since there is only one breaker with a common tripping mechanism, there is no need for special connections of pole units of different breakers as in FIGS. 1 and 8. As shown, the first terminals of pole units 246B and C are connected together, the first terminals of pole units 246D and E are connected together, the second terminals of pole units 246A and B are connected together, and the second terminals of pole units 246E and F are connected together. As before, the two outermost first terminals 246A and F are connected to the line alternating current supply terminals 14 and 16 and the two innermost second terminals are connected to the bus terminals 20 and 22. As before, a fault across bus terminal 20 and 22 or between either bus terminal and neutral causes all six pole units to open, clearing the circuit.

Figure 2:
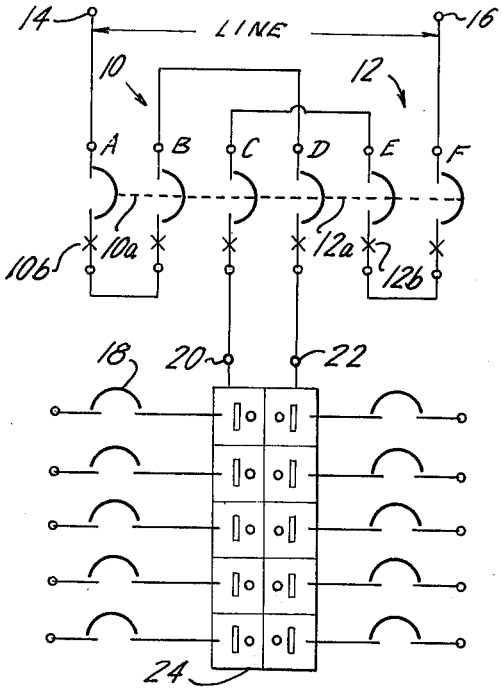
FIG. 2 is a schematic of the panel of FIG. 1.

Any of the breakers illustrated in FIGs. 1, 8 or 9 can be used for protecting a supply line connected to a load; and in particular the load as a panelboard or load center as shown in FIGS. 1 and 2.

Another panel configuration is shown in FIG. 10. Two 2-pole breakers 248 and 250 constitute the main breaker providing four pole units and a 2-pole branch breaker 252 provides additional two poles available to clear a fault across the load terminals of the branch breakers. The first terminals of pole units 248A and 250D are connected to the terminals 14 and 16, the first terminals of pole units 248B and 250C are connected to the second terminals 250D and 248A respectively, and the second terminals of pole units 248B and 250C are connected to bus terminals 20 and 22 of a bus assembly 24. This bus assembly is (as in U.S. pat. No. 3,041,505, issued to A. R. Norden) sequence-phased so that portions 24a and 24b are connected to bus terminals 20 and 22 alternately. Pole units 252E and 252F of the two-pole breaker 252 are connected to bus terminals 20 and 22, respectively, and (as usual) pole units 252E and 252F have a coordinating trip means to trip both poles in case of a fault in either pole. Because of the arrangement of the terminals, the outermost first terminals 248A and 250D are connected to the line alternating current supply terminals 14 and 16 and the innermost second terminals 248B and 250C are connected through the panel bus to the first terminals of branch breaker pole units 252E and F, respectively. The second terminals of branch breaker pole units 252E and F form the load terminals of the circuit. Should a severe fault occur between the second terminals of branch breaker 252, or between either second terminal of breaker 252 and neutral, all six breaker pole units would open clearing the circuit, provided that breakers 248, 250 and 252 have reasonably equal response characteristics to faults of short circuit magnitude. Breakers 248 and 250 should have reasonably equal sensitivities to moderate overcurrents, but the overcurrent sensitivity of branch breaker 252 may be much lower than that of breakers 248 and 250.

Due to inclusion of over-current responsive devices in each of its pole units, both halves of the main interrupter 248–250 of the panel would open in case of a load-to-neutral fault. However, breakers 248 and 250 form a main interrupter that can provide protection against a short-circuit in the panel itself only where those breakers alone are of suitably effective construction. This factor is discussed further below.

The circuit breakers and panel of FIg. 1 are schematically illustrated in FIG. 2. Description of the corresponding parts is not repeated here. Handles 10a and 12a are represented in FIG. 2 by dotted lines. Each pole of the three-pole circuit breakers 10 and 12 includes a thermal and magnetic overload release device represented by a small *x* 10*b* and 12*b*. FIG. 2 includes a diagrammatic illustration of the panel bus 24. This bus may be designed for plug-in circuit breakers, or the bus may be adapted for use with branch circuit breakers having screw-in line terminals.

Coupling is provided between the operating handles 10*a* and 12*a* to enforce common manual operation for all the pole units, so that both sides of the bus assembly will be energized and deenergized concurrently. The same handle coupling is included for all the pole units of the main interrupter in FIGS. 8, 9 and 10. This coupling between the handles of separate devices constituting the main interrupter also provides a further safeguard. It may be considered that the short-circuit characteristics of pole units 10A and 10B are matched but that the matched short-circuit characteristic of pole units 10A and 10B is slightly different from that of pole unit 12D. If a fault should occur within the marginal difference between the sensitivity of pole units 10A and 10B and the sensitivity of pole unit 12D, only breaker 10 or 12 would open. The handle coupling between all the pole units of the main interrupter provides assurance of the desired operation even under unusual fault conditions.

Figure 3:
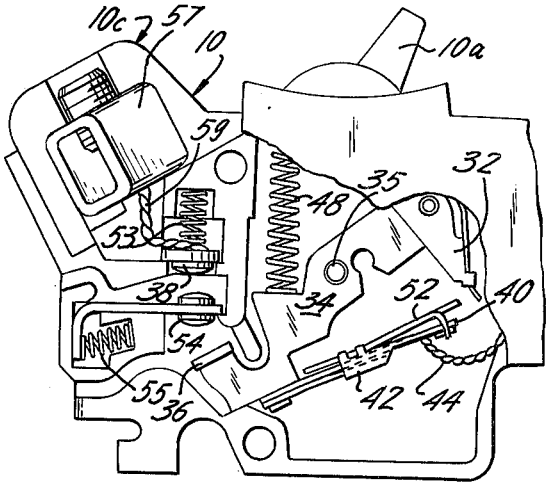
FIGS. 3, 4 and 5 are lateral views of three different circuit breaker pole units, useful for present purposes, parts being broken away or removed and in FIGS. 4 and 5, parts being shown in cross section.

Circuit breakers 10 and 12 may be the commercially available 3-pole 100-Ampere "STAB-LOK" circuit breakers, generally described in U.S. Pat. No. 3,134,871, issued on May 26, 1964 to A. R. Norden. A portion of a pole unit 10A of such a circuit breaker 10 (FIG. 1) is illustrated in FIG. 3.

The pole unit 10A includes a main molded part and a cover, the cover being broken away partly to reveal the internal mechanism. Contact arm 34 on a pivot 35 in each of the poles, carries bell crank 32 pivotally at one extremity, and at the opposite extremity of contact arm 34 there is a moving contact 36. Current-sensing bimetal 40 and magnetic yoke or pole 42 are electrically and mechanically united to contact arm 34 at their left extremity as viewed in FIG. 3, and bimetal 40 has a flexible copper braid 44 connecting it to the lower or "second" terminal 46 of pole unit 10A.

When handle 10*a* is moved counter-clockwise about its pivot (not shown) a toggle mechanism (also not shown) causes bell crank 32 to engage one end of armature 52. Armature 52 is pivoted on magnetic yoke 42, and is biased counter-clockwise by a suitable spring (not shown). Once bell crank 32 engages armature 52 further counter-clockwise movement of handle 10a causes contact arm 34 to pivot clockwise on pivot 35 causing contact 36 to be raised against an intermediate contact 54 which is forced upward against a "stationary" contact 38 connected to upper or first terminal 57 of FIg. 1. Contact 38 is biased downward by spring 53. Intermediate contact 54 is carried on an arm biased by spring 55 that biases the contact toward the position shown in FIG. 3. Closing motion of contact arm 34 drives contact 54 upward, to bear against contact 38.

When the circuit breaker is closed and carrying current, a moderate overload current will cause a gradual downward deflection of bimetal 40 pulling armature 52 with it. In the event of a severe overcurrent, a magnetic attraction between yoke 42 and armature 52 will cause a sudden downward deflection of armature 52. When deflected downward due to either of these conditions, armature 52, which acts as a latch for bell crank 32, will move out of the clockwise path of the lower extremity of bell crank 32. When that occurs, spring 48 becomes free to drive contact arm 34 counter-clockwise and thereby drives moving contact 36 to its open position while spring 55 moves contact 54 to its open position.

In the open position of the circuit breaker, the combined distances represented by the separation between contacts 38 and 54 and contacts 36 and 54 is about one-fourth inch in the commercial 100 Amp Stab-lok circuit breaker of FIG. 3. This is approximately the same, in aggregate, as the contact separation between contacts of other similar Stab-lok circuit breakers having only contacts 36 and 38 and having a lower load current ratings such as the type in U.S. Pat. No. 2,923,788, issued on Feb. 2, 1960 to A. R. Norden. Moreover, in commercial practice both types have essentially the same kind of operating mechanism. The operating mechanics of each of the pole units includes a pivoted contact-carrying arm, articulated to the operating mechanism. The arm carries the overcurrent release means. The length of the contact arm from its pivot to the remote end of its moving contact in the commercial form of both breakers is about 1 3/8 inches. Both breakers have a response time, measured between the incidence of a severe overcurrent and complete contact parting travel of the moving contact, of less than about one-fourth cycle at 60 hertz. Their arc chutes are of the same kind, in that they consist of urea molded enclosures and they do not depend on assembled ferrous deionizing plates for arc extinction. In both commercial forms (Norden '871, FIG. 3 and Norden ''788) they have the same current interruption rating, either 5,000 amperes or, with some modification, 10,000 amperes. The term pole unit defined above comprises the contacts, the enclosed arcing space identified with the contacts of the circuit breaker in FIG. 3, and the contact arm. It is not always necessary for an overcurrent release to be included in every pole unit. For example, overcurrent release 10b could be replaced in pole unit 10B by a copper strip fixed to arm 34 to act as a fixed latch replacing bimetal 40 and armature 52. In any case, all the pole units are coordinated for release in response to a severe overcurrent.

The bimetals in four of the 6 pole units forming the main interrupter shown in FIG. 1 were replaced by sold copper bars in a test circuit breaker system on the form in FIG. 3, leaving one bimetal in each series of pole units between each line terminal 14, 16 and its corresponding load terminal 20, 22. The test results were the same with bimetals in all six poles as with bimetals in only two pole units, demonstrating that interruption of high available current does not depend upon the resistance introduced by six bimetals when present in all 6 pole units.

Figure 4:
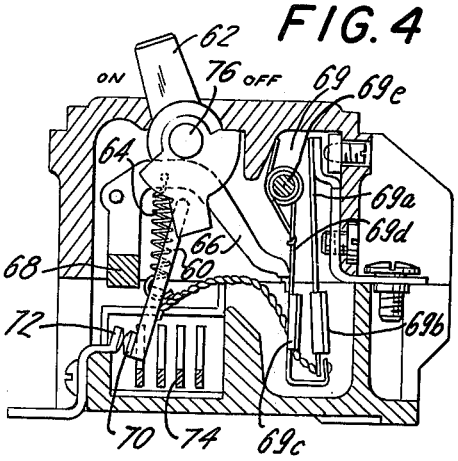

Another form of 3-pole circuit breaker useful in FIG. 1 is shown in FIG. 4. This is of the so-called quick-lag type of mechanism in U.S. Pat. No. 2,811,607, issued to H. D. Dorfman et al on Oct. 29, 1957. In this mechanism, a contact arm 60 has its upper extremity received pivotally in a recess in handle 62. Coil spring 64 tensions contact arm 60 up into its pivotal recess, the upper extremity of spring 64 being received in a hole in cradle 66. All three cradles 66 of the 3-pole circuit breaker are attached to a tie bar 68 which is pivoted at its ends. The cradle 66 of the middle pole unit, 10B or 12E in FIGS. 1 and 2, is latched by an overcurrent release mechanism 69. The cradles of the pole units on either end of the breaker 10A, 10C, 12D or 12F do not have latched ends. The overcurrent release mechanism, by latching the middle cradle restrains the cradles against clockwise movement about the end pivots of tie bar 68. Cradle 66 is illustrated in its latched condition and the circuit breaker is shown with the contact closed. The overcurrent release means 69 includes a bimetal 69*a* in each pole unit, the lower end of which deflects to the right when heated by moderate persistent overcurrent. Armature 69c is carried by a J-shaped member 69d which serves as the latch for cradle 66 in the center pole unit. J-shaped members of the companion pole units are united by rotatable rod 69e to member 69d. Deflection of the bimetal 69a causes release of cradle 66. A sudden severe overcurrent causes armature 69*c* to be shifted toward pole-piece 69*b*, as another means of releasing cradle 66.

In the event of an overload or short circuit in any pole unit of the 3-pole breaker, mechanism 69 releases middle cradle 66 for clockwise motion of all the cradles about the tie bar pivot and the upper end of each spring 64 shifts across the line between the pivotal end of contact arm 60 and the hooked connection of spring 64 to arm 60. The result is a snap-opening of the contact arm. During the opening motion of contact arm 60, an arc is drawn between each moving contact 70 and its stationary contact 72 and this arc is quenched by arc chute 74, which, as illustrated, includes a series of mutually separated ferrous arc-splitter plates. Handle 62 is constrained to rotate clockwise around its pivot 76 to a "tripped" position between the "off" and "on" positions.

Release of the middle cradle in a 3-pole circuit breaker of this construction due to an overcurrent condition in any of the pole units of the breaker causes all of the pole units to operate virtually concurrently. Cross coupling among the pole units is well known and is illustrated for example in U.S. Pat. No. 3,550,047, issued Dec. 22, 1970, to F. L. Gelzheiser. The opening of the contacts in a circuit breaker of this type as commercially made is commonly of the order of 9/16 of an inch.

Circuit breakers of the type illustrated in FIGS. 3 and 4 are known industrywise as residential mold-case breakers. They are of a type having a single-pole current interruption rating of 5 to 10,000 amperes at 120 volts.

Molded case circuit breakers larger than residential breakers are often called industrial breakers. Their maximum rating is usually 600 volts. A common type of 480-volt AC industrial breaker, the E-frame breaker, is described in U.S. Patent No. 2,673,264, issued on Mar. 23, 1954 to T. M. Cole, and also in U.S. Pat. No. 3,274,357, issued on Sept. 20, 1966 to A. E. Maier et al, both patents assigned to Federal Pacific Electric Company, the assignee hereof. A portion of the central pole unit of a commercial form of such a 3-pole industrial breaker is illustrated in FIG. 5, an NEJ-frame breaker made by Federal Pacific Electric Company (assignee hereof) in ratings of 125 Amp to 225 Amp at 240 volts, with a single-pole current interrupting capacity of 10,000 Amps.

Figure 5:
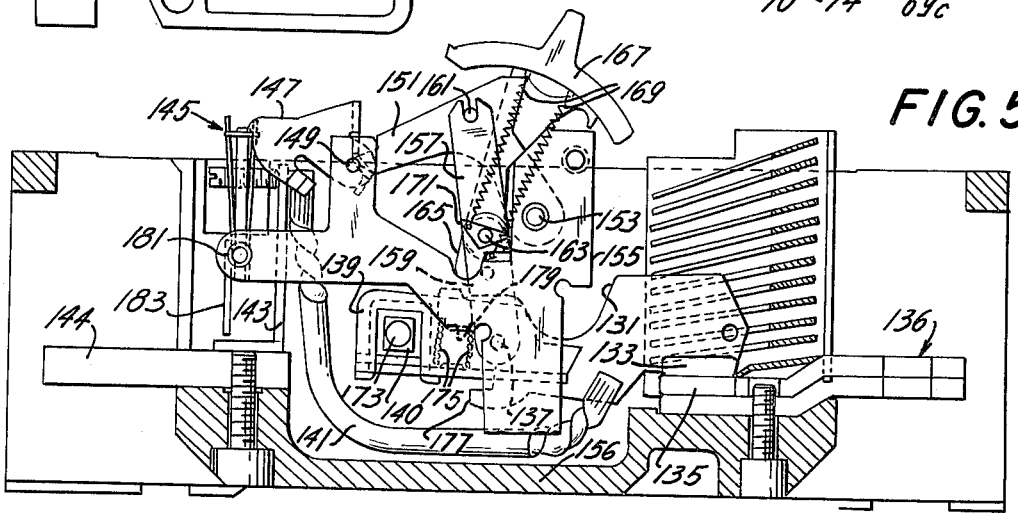

As viewed in FIG. 5, the breaker cover is removed and the molded base is shown partly in cross section to reveal details of the mechanism. A contact arm 131 carries a movable contact 133 which engages companion contact 135 when the breaker is closed, as illustrated. Companion contact 135 is connected to a first terminal 136. Contact arm 131 is carried by pivot 137 on contact arm carrier 139 which in turn is mounted on insulated shaft 140. A conductive flexible braid 141 conducts current from the contact arm to bimetal 143, which bimetal 143 is connected to a second terminal 144. Deflection of bimetal 143 to the left as a result of sustained moderate overcurrent shifts primary latch 145 to the left, releasing secondary latch 147 and cradle 151. Primary latch 145 is part of a trip bar extending across like regions in the companion pole units, for activation by the overcurrent responsive means of those pole units. Pivot 149 of latch 147 and pivot 153 of cradle 151 are carried by a frame 155 which frame is fixed to the breaker base 156 in a manner not illustrated. A pair of toggle links 157, 159 extend from pivot 137 to a pivot 161 on cradle 151, the links being pivotally connected to each other at knee 163.

An operating lever 165 pivotally mounted on frame 155 carries an operating handle 167. Springs 169 extend from the top of the operating lever to a bracket 171 at the toggle knee 163.

With the latch 147 and cradle 151 secured by primary latch 145, the operating handle 167 and operating lever 165 can be moved clockwise on frame 155 to close the breaker. At the point where the springs shift to the right of pivot 161 they act on the toggle knee 163 to pull the toggle links 157, 159 into an erect position. The toggle, acting on pivot 137, forces contact arm carrier 139 and contact arm 131 and insulated shaft 140 to pivot into the closed position shown. The contact arm carriers and contact arms of the companion poles breaker (not shown) are also mounted on the insulated shaft 140, so that moving the operating handle clockwise causes all the pole units of the breaker to close.

After movable contact 133 engages companion contact 135, the carrier 139 continues to pivot clockwise. Thereafter, contact arm 131 rotates counterclockwise around pivot 137, using the point of contact between contacts 133 and 135 as a fulcrum. Compression coil spring 175 acts between part 179 of contact arm 131 and carrier 139 to provide assurance that each of the movable contacts will make the proper engagement with its companion contact.

To open the breaker manually, the operating handle 167 is moved to the left. Operating arm 165 rotates counterclockwise, shifting springs 169 to the left of pivot 161, causing collapse of the toggle. The contact arm carrier 139 rotates counter-clockwise arount pivot 173, causing shaft 140 to rotate similarly. As contact arm carrier 139 rotates counter-clockwise, spring 175 forces contact arm 131 to maintain contact 133 in engagement with contact 135 and to rotate clockwise around pivot 137 until stop 177 engages carrier 139. Further counterclockwise rotation of the carrier 139 and the contact-carriers of the companion pole units (not shown) causes the pole units to open.

If the breaker were in a closed position and a sustained moderate overcurrent condition were to occur, the bimetal 143 would deflect to the left causing the primary latch 145 to rotate counter-clockwise around pivot 181. A severe overcurrent condition would cause armature 183 to be attracted toward current-carrying bimetal 143, similarly activating primary latch 145. In either case, latch 147 would be released, releasing cradle 151 and causing springs 169 to cause the toggle to collapse and the breaker to open. With the over-current condition removed, movement of the operating handle 167 and operating lever 165 to the left causes the operating lever 165 to engage the cradle, rotating it counter-clockwise to re-engage the secondary latch 147, causing this latch to re-engage the primary latch 145. With the cradle latched, movement of the operating handle to the right will close the breaker, as described above.

Two three-pole NEJ frame breakers of the form illustrated in FIG. 5 have been connected to serve as breakers 10 and 12 of FIG. 1 and operated successfully in interrupting very high levels of available current, as discussed more fully below. The reason for using the NEJ breaker here is that it can be used to provide a nominal main circuit breaker rating of 225 Amps. Other E-frame breakers having similar dimensions and lighter contact arms may well provide high available-current interruption capacity. However, such other E-frame breakers are usually limited in nominal ratings to 100 Amps. Since E-frame breakers are inherently more bulky and more expensive than the residential molded case breakers discussed above, and since three-pole residential breakers are commonly available in the nominal 100 Amp rating, the smaller residential breakers would be used in the system of FIG. 1 except where the higher nominal rating of the 225 Amp NEJ breaker is needed.

An important distinction between residential molded case breakers of the form having pivoted contacts and industrial molded case or "frame" breakers is in the comparative lengths and masses of their contact arms, from the pivot to the remote end of the movable contact in each case. Contact arms of residential breakers are normally less than 1½ inches long and about 0.04 inch thick whereas the contact arms of E-frame breakers are substantially longer and they are more massive.

Residential breakers and the NEJ frame breaker have a common feature that is important here, namely, their "response time". As stated above, this is the time between the incidence of a severe overcurrent condition and the full open position of the contacts. In these breakers, the response time is less than about 4 milliseconds or one-fourth cycle at 60 hertz.

The short length of contact arms of residential breakers and the relatively small mass of metal in such arms result in a low moment of inertia. This, in turn contributes towards establishing full opening of the contacts of each pole unit in a very short time interval. The large total contact opening space of three such pole units in series is thus realized remarkably fast. Additionally, the enclosure of each pole unit provides a contained arc chamber for the contacts of each pole unit which is physically isolated from the heat, gas pressure and ionization of the two other series sets of contacts and arc chambers of the other pole units. These factors make it possible for these breakers, when connected as breakers 10 and 12 of FIG. 1, to protect a circuit where the available current is enormously greater than that for which the circuit breakers were designed.

By way of comparison, each pole unit of a commercial NEJ frame circuit breaker such as that illustrated in FIG. 5, has a much heavier and longer combined contact arm carrier and contact arm and a heavier moving contact and a correspondingly greater moment of inertia. In addition, the NEJ frame breaker has approximately the same aggregate contact separation as three sets of contacts in residential molded case breakers such as those represented in FIG. 3. Additionaly, the multipole NEJ frame breaker has larger arc chambers and they are equipped with ferrous arc-splitter plates. In spite of all these features, the rated single-pole current interruption capacity of the NEJ breaker is only 10,000 amperes at 240 volts A.C. When utilized as in FIGS. 1 and 2, two NEJ 3-pole breakers are capable of clearing a circuit where the available current is about 100,000 amperes at 240 volts A.C.

Quick-lag circuit breakers of the type shown in FIG. 4 have been reputed to operate and interrupt a circuit whose voltage is 240 A.C., where there is a short-circuit available current of the order of 65,000 RMS symmetrical amperes. The current path through such a circuit breaker inherently produces electro-dynamic contact-parting forces during moments of high instantaneous current, which greatly accelerate the opening speed of the contacts. However, even in the case of a circuit breaker proportioned for electro-dynamic contact parting, where the available current is appreciably less than 65,000 amperes the electrodynamic contact-opening force is sharply reduced so that current interruption below the 65,000 Amp level may be marginal. In any case, the arc interruption process depends upon the current wave crossing zero, the arcing energy is great, and the damage and erosion tend to be relatively great.

Unlike the above described quick-lag type of breaker used in the usual way, two 3-poel circuit breakers, when connected in the configuration described in FIGS. 1 and 2 are not only capable of arc interruption when the available current is 100,000 amperes and higher, but are equally effective for all levels of available current below 100,000 amperes. Additionally, the limited arcing energy minimizes the damage and erosion to the circuit breakers.

The effectiveness of two three-pole circuit breakers configured as illustrated in FIGS. 1 and 2, in interrupting a short circuit when the available current is much greater than the rated current interrupting capacity of the individual breaker is demonstrated by the oscillograms of FIGS. 6 and 7. Each test was run under the following conditions: Each line terminals was connected to the source voltage by 4 feet of copper wire. The simulated short circuit consisted of two 10 inch copper wires bolted together to form a twenty-inch short across the load terminals. The size of the line and load wires used depended on the nominal current rating of the breakers to which they were attached, according to the following listing:

| BREAKER | WIRE USED |
|---|---|
| 100 amp | No. 1 copper |
| 70 amp | No. 4 copper |
| 50 amp | No. 6 copper |
| 40 amp | No. 8 copper |
| 30 amp | No. 10 copper |
| 15 amp | No. 14 copper |

Reactance was inserted in the connection of the source to the breakers to simulate a line having a predetermined lagging power factor. The voltage source was 240 volts A.C. at 60 hertz. As a preliminary of the test, the breakers were manually closed and then a closing switch in the source was closed as the voltage passed through a predetermined angle.

Figure 6A:
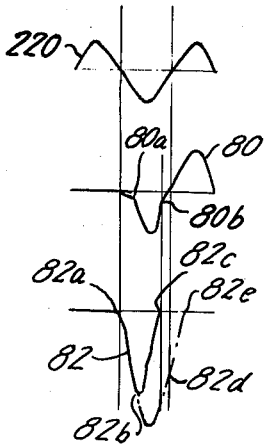
FIGS. 6A, 6B and 6C is a series of oscillogram traces, two three-pole breakers of the -pole in FIGS. 3, 4 and 5, connected as a novel 2-pole breaker system.
Figure 6B:
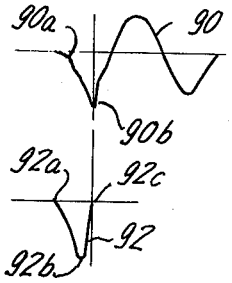
Figure 6C:
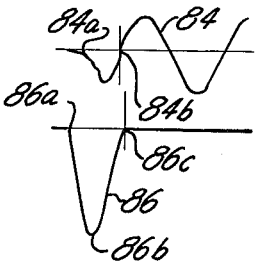

The oscillograms of FIGS. 6A, 6B and 6C represent the response of the breakers where the simulated short circuit was connected across the load terminals of breakers 10 and 12 and the available current was 15,000 amperes at 240 volts A.C. A 45% power factor was established by appropriate reactance.

Figure 7A:
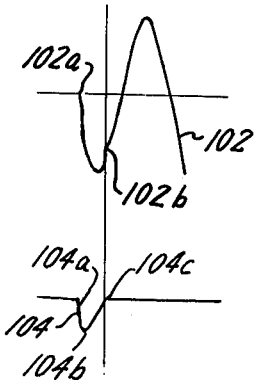
FIGS. 7A, 7B and 7C is a series of oscillogram traces representing the performance of the panel in FIGS. 1 and 2.
Figure 7B:
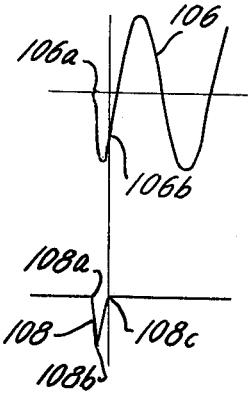
Figure 7C:
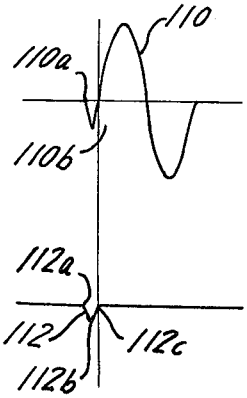

The oscillograms of FIGS. 7A, 7B and 7C represent the response of the breakers where the simulated short was connected across two of the branch breakers and the available current was 100,000 amperes. A 90% power factor was established.

FIG. 6A represents the response of two 3-pole circuit breakers of the form of breaker shown in FIG. 3, involving 6 poles in series across a 240 volt line where the available current was 15,000 amperes. Trace 80 represents the voltage wave developed across the line terminals of the breaker, and trace 82 represents the current through the breaker. The closing switch was closed at 0 degrees, point 82*a*, and the current started to rise, reaching a peak at point 82*b*. Up to that moment in this test the contacts of the circuit breaker were closed. As evidenced by the break in the voltage wave, the contacts started to open at point 80*a*, causing arcing in each of the 6 series pole units. The current was interrupted at point 82*c*.

Trace 220 provides a representation of the source voltage. It will be noted that the current was interrupted at point 82*c*, which is before the source voltage crossed the zero axis. Naturally, after the current was interrupted, the voltage across the line terminals picked up and followed the source voltage. This early interruption of the current is remarkable. For comparison purposes the shape of a current wave 82*d* is shown as a dotted line, representing the current that would flow if the breaker were replaced by a solid conductor having an impedance equal to that of the breaker. As shown, current wave 82*d* follows the source voltage current rise, continuing after the voltage peaks and reaching zero point 82*e* after the voltage, due to the reactive quality of the supply circuit. Yet here, the six sets of contacts opened and quenched the arcs to force interruption of the current at point 82*c*, in advance of the zero cross-over of the voltage wave. In addition, at the time of current interruption, the voltage wave had a value represented by point 80*b*, and had not yet decreased to zero.

Figure 12:
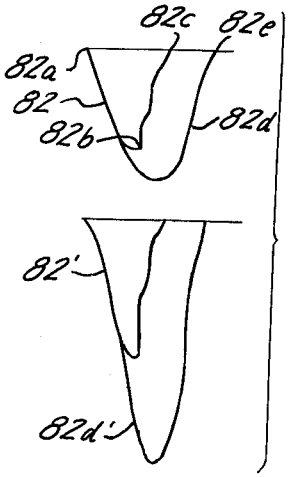
FIG. 12 is a series of traces of the actual and hypothetical interrupted currents of FIG. 5A, and corresponding energies.

The energy dissipated at the six sets of contacts is equal to the integral of $I^2dt$ during arcing, that is, from point 82*a* to 82*c*. The fact that interruption was forced in advance of zero cross-over of the voltage wave signifies a reduction in the arcing time as compared to interruption at or after zero cross-over. The area under the actual current wave 82 is substantially smaller than the area under curve 82*d*. This is clearly shown in FIG. 12 where besides reproducing curves 82 and 82*d* of FIG. 5, the curves 82′ and 82*d*′ represent the square of the instantaneous values of currents 82 and 82*d*. The area under curve 82′ represents the arcing energy in the actual interruption, and the area under 82*d*′ represents the energy of the current involving no current limitation. The current wave 82 has a peak 82*b* whose value was 8345 amperes in a typical test. Since the time of arcing and the peak value of the current (as well as its RMS value represented by the area under curve 82′) were both reduced as compared to those developed in the course of usual interruption of short-circuit current where current limitation is not significantly involved, it follows that the total energy to be dissipated at the six sets of contacts is remarkedly reduced, and the energy to be dissipated at any one set of contacts is dramatically reduced.

A breaker interrupting a specified circuit, which severely limits the magnitude of the arcing current to a level much lower than that which is normally achieved by the breaker pole units, and which in addition has the capability of driving the current to zero without depending on the source voltage reaching zero, is defined herein to be a "current limiting breaker." It will be understood that where the incidence of the over-current develops late in the voltage wave, there may not be time for the breaker to demonstrate its ability to force the current to zero. Even then, typically, the rise of current is restricted and the current will be interrupted as the voltage decreases to zero.

FIG. 6B represents the interruption of current of two 3-pole circuit breakers of the type shown in FIG. 4. At point 92*a* on current curve 92, the closing switch placed all 6 poles of the breaker in series across the line. The closing angle was 0° and the current started to rise. At point 90*a* on voltage curve 90, the breaker contacts parted and arcing was started. The current reached its peak value of 5,625 amperes at point 92*b*. Thereafter it decreased until point 92*c* at which time it was interrupted. At the moment of arc interruption, a momentary spike 90*b* appeared in the voltage wave, which resumed its decrease to zero.

Repeating the same test where the closing angle was 90° in the voltage wave, the same curve shapes resulted, the current rising to a peak value of only 5,400 amperes.

FIG. 6C illustrates typical performance of a two-pole residential breaker, for comparison with the above tests. A similar test was run with a standard commercial 2-pole circuit breaker of the type shown in U.S. Pat. No. 2,662,949 issued on Dec. 15, 1953 to P. M. Christensen et al. Under the above test conditions (240-volt circuit with 15,000 amperes of available current, 45% power factor, with the breaker initially in closed condition), the closing switch was closed at the 0° crossing of the alternating current supply. As shown in FIG. 6C, current started to flow at point 86*a*. Tripping of the mechanism followed shortly afterward, the contact-separation starting at point 84*a* and arcing continuing until current interruption at point 86*c*. Notably the voltage wave has approached and (due to the lagging power factor of the supply) the voltage had crossed zero when current interruption was effected. The peak value 86*b* of the arcing current was 11,025 amperes and the duration of the arcing current (points 84*a* to 84*b*) was much longer than that of FIG. 6A (points 80*a* to 80*b*) or FIG. 6B (points 90*a* to 90*b*). Consequently, the integral of $I^2dt$ was much greater for the two sets of contacts in this test breaker than the aggregate energy distributed among six sets of contacts in the case of FIG. 6A or 6B. In this test, the current interruption rating of this circuit breaker was actually exceeded, but it helps to demonstrate, by contrast, the importance of forcing the current to zero, without awaiting a zero-crossing time in the operation of usual breakers of this class.

Tests were run on a panel as shown in FIGS. 1 and 2 where the available current was 100,000 amperes and the fault was across the load terminals of the branch breakers. Tests were run with two NB 3P 100 amp breakers, of the type shown in FIG. 3, as the main interrupter 10 and 12 in FIGS. 1 and 2, and with two NEJ 3P 225 amp breakers, such as shown in FIG. 5, as the main interrupter. Various breakers were used for the branch breakers. The following table shows the equipment used in each test and the results thereof:

TABLE I

CURRENT LIMITING CIRCUIT BREAKER TEST

| TEST No. | BRANCH BREAKER | CLOSING ANGLE | $I_{LT}$ | $I^2t$ |
|---|---|---|---|---|
| Main Circuit Breaker - Two NB 3P 100A | | | | |
| 1 | NA 2P70H | 0° | 9,206.99 | 144,106.66 |
| 2 | NA 2P70H | 90° | 11,358.63 | 94,709.47 |
| 3 | NA 2P70H | 90° | 8,981.82 | 145,211.57 |
| 4 | NC015 | 90° | 7,205.47 | 57,110.67 |
| 5 | NC015 | 0° | 5,954.52 | 81,549.51 |
| 6 | NA015 | 0° | 6,630.04 | 87,913.80 |
| 7 | NA015 | 0° | 6,504.94 | 84,628.49 |
| 8 | NA2P50 | 0° | 8,981.82 | 112,942.33 |
| 9 | NA2P50 | 90° | 10,007.60 | 62,016.17 |
| 10 | NA2P50 | 0° | 9,081.89 | 131,969.16 |
| Main Circuit Breaker - Two NEJ 3P 225A | | | | |
| 11 | NA2P70H | 0° | 8,786.67 | 146,523.68 |
| 12 | NA2P70H | 90° | 13,935.58 | 135,940.28 |
| 13 | NA2P125 | 90° | 15,887.07 | 201,919.19 |
| 14 | NA2P125 | 0° | 12,809.73 | 262,542.69 |
| 15 | NC015 | 90° | 7,205.47 | 62,302.61 |
| 16 | NC015 | 0° | 6,805.17 | 83,358.62 |
| 17 | NC030 | 0° | 8,706.61 | 121,288.09 |
| 18 | NC015 | 135° | 4,903.73 | 14,427.94 |
| 19 | NC030 | 90° | 10,282.81 | 74,015.33 |
| 20 | NA2P125 | 0° | 12,384.41 | 276,072.50 |

All of the breaker configurations listed above cleared the circuit, and in all of the tests except No. 18, the current reached zero without depending on the voltage reaching zero. FIG. 7A, which is the trace of test No. 11, is illustrative of all the tests where the closing angle was 0°. FIG. 7B, which is the trace of test No 12, is illustrative of all the tests where the closing angle was 90°. As before, traces 102 and 106 are the voltage waves developed across the line terminals of the main interrupter. The current through the panel started to rise at points 104*a* and 108*a*. Since the available current was 100,000 amperes, the large current passing through the panel caused an immediate voltage drop 102*a*, 106*a* across the line terminals. This makes it difficult to determine the exact point when arcing started, but the current reached its peak at points 104*b* and 108*b* and was interrupted at points 104*c* and 108*c*, while the voltage 102*b*, 106*b* was approaching zero.

In test No. 18, FIG. 7C, the panel with its closed breakers was energized at a closing angle of 135°. The current started to rise at point 112*a* on current trace 112, and voltage started an immediate rise at point 110*a* on voltage trace 110. Because of the angle of closing, the arc drawn by the opening of the breakers peaked at point 112*b*, and was extinquished at point 112*c*, when the line voltage reached zero, point 110*b*. The angle of closing was too close to the end of the voltage wave for the breaker to force the current to zero before the voltage reached zero. Still, as shown by FIGS. 7A and 7B, the breaker is a current limiting breaker.

The panel configuration of FIG. 10 was tested under 100,000 amperes available current conditions. Two 2-pole 100 amp quick-lag breakers, of the type shown in FIG. 4, were used as the main interrupter. Tests were run with a 70 amp 2-pole breaker as the branch breaker, and with a 15 amp 2-pole breaker as the branch breaker, these branch breakers also being similar to that of FIG. 4, made by the Square D Company. Although 3-pole breakers were used as the main interrupter in the test, only two of the pole units of each breaker were connected in series. Since the test was a fault across the load terminals of the branch breakers in which the four main breaker pole units and the two branch breaker pole units were in series, the breakers forming the main interrupter were not interconnected. The breakers collectively cleared the circuit, evidencing current limiting operation. FIGS. 11A and 11B are representative of all the tests, where the closing angle was 0° and 90° respectively. As before, traces 260 and 262 represent the voltage wave developed across the line terminals of the main interrupter and traces 264 and 266 represent the current through the breakers. With the branch manually closed, the alternating current source was applied across the line terminals of the main. The current through the breakers started to rise at points 264*a* and 266*a*, and since the available current was 100,000 amperes, the voltage across the line terminals started to rise at points 260*a* and 262*a*. Current reached its peak 6,450 amperes at 264*b* and 15,400 amperes at 266*b* and was extinguished at points 264*c* and 266*c* while the voltage 260*b*, 262*b* was approaching zero. Although there were spiked voltages and a fairly large current at point 266*b*, the tests show this breaker configuration to be a current limiting interrupter.

Tests were also run on the main interrupter configuration shown in FIGS. 1 and 2 where the available current was 100,000 amperes at 265 volts and the fault was across the load terminals 20 and 22 of the main interrupters. No branch breakers were utilized in these tests.

One series of tests were run with two NB 3P 100 Amp breakers of the type shown in FIG. 3 as the interrupter 10 and 12 of FIGS. 1 and 2; a second series of tests were run with a new sample of the same type of interrupter; a third series of tests were run with two NEJ 3P 225 Amp breakers, of the type shown in FIG. 5 as the interrupter; and a fourth series of tests were run with two NEJ 3P 125 Amp breakers of the type shown in FIG. 5 as the interrupter. Each test series started with the breakers manually closed. The alternating current source was then applied across the line terminals of the interrupter. After the breaker had responded to the over-current condition by opening, it was manually reset. Again, the over-current condition would cause the interrupter to open and again it would be manually reset. The successful opening of the breaker for the third time, concluded each test. In all four series of tests the breakers cleared the circuit each time they opened, and each time they opened the current reached zero without depending on the voltage reaching zero. The following table shows the results of each test:

TABLE II

Current Limiting Circuit Breaker Test with 100,000 Ampere Available Current at 265 Volts

| TEST No. | $I_{it}$(ka) | t(milliseconds) |
|---|---|---|
| INTERRUPTER - Two NB 3P 100A | | |
| 1 | 14.0 | |
| 2 | 8.4 | 6.0 |
| 3 | 9.7 | 8.4 |
| INTERRUPTER - Two NB 3P 100A | | |
| 4 | 9.8 | 5.4 |
| 5 | 8.1 | 1.2 |
| 6 | 7.0 | 1.2 |
| INTERRUPTER - Two NEJ 3P 225A | | |
| 7 | 17.2 | 4.8 |
| 8 | 23.1 | 3.6 |
| 9 | 21.0 | 3.8 |
| INTERRUPTER - Two NEJ 3P 125A | | |
| 10 | 16.8 | 5.4 |
| 11 | 14.0 | 5.4 |
| 12 | 15.7 | 1.2 |

The two common forms of residential molded-case circuit breakers shown and described are utilized in achieving enormously increased current interrupting capacity, with current-limiting characteristics and remarkably reduced arcing damage. Those described residential breakers have pivoted contact arms. However, like results can be achieved with series-connected pole units of other well-known inherently compact residential molded-case breakers having inherent fast response times and interruption ratings comparable to those described above. For example, such other breakers include those wherein each pole unit compresses a pair of stationary contacts and a reciprocating structure bearing a bridging contact member, and those wherein each pole unit comprises a moving contact carried by a structure that reciprocates in closing the breaker but wherein the moving contact is carried by an overcurrent responsive member pivoted to the reciprocating structure. Moreover, while two groups of series-connected coordinated pole units are described above as constituting a two-pole interrupter, it is evident that like results can be achieved with three groups of series-connected coordinated pole units of the types described constituting a three-pole interrupter for a three-phase supply. These and other variations of the illustrative embodiments detailed above will be readily apparent to those skilled in the art and consequently the invention should be construed broadly in accordance with its full spirit and scope.

I claim:

1. A circuit interrupter for a three-wire single phase, 240-volt alternating current supply comprising first and second line terminals and a neutral and having an available current greatly in excess of 10,000 amperes, said interrupter including a plurality of pole units of the molded case air breaker class, each pole unit having at least a movable contact and a companion contact engaged thereby and each pole unit having a molded case of insulation containing said contacts and providing enclosed arcing space for the contacts thereof two of such pole units where arranged as a two-pole breaker having an interruption capacity of 5,000 Amps at 240 volts A.C., operating means for said movable contacts of said plurality of pole units, a first half of said plurality of pole units being connected in series in a first circuit for interposition between the first line terminal and a first load terminal and a second half of said plurality of pole units being connected in series in a second circuit for interposition between the second line terminal and a second load terminal, means for effecting coordinated release of said operating means in response to a fault and for effecting coordinated opening operation of the movable contacts of all said pole units, said release means including at least one overcurrent sensing device in each of said first and second series circuits, said coordinated pole units limiting the rise of fault current and driving the fault current to zero without dependence on the A.C. source voltage decreasing to zero.

2. A circuit interrupter as claimed in claim 1, wherein the movable contact of each of said plurality of pole units is operable by said operating means upon release in response to an overcurrent for effecting full opening of said contacts in less than about 4 milliseconds.

3. A circuit interrupter as claimed in claim 2, wherein said movable contact in each of said plurality of pole units is mounted on a pivoted contact arm and wherein the length of said movable contact arm is less than about one and one-half inches from the pivot to the movable contact.

4. A circuit interrupter as claimed in claim 3, wherein said movable contact arm in each of said pole units has its own actuating mechanism.

5. A circuit interrupter as claimed in claim 3, wherein said contacts of each of said plurality of pole units include a main movable contact, an intermediate movable contact and a companion contact.

6. A circuit interrupter as claimed in claim 2, wherein said movable contacts in each of said half of said plurality of pole units are supported by movable contact carriers connected together by a pivoted tie bar.

7. A circuit interrupter as claimed in claim 1, wherein all of the pole units are united so as to constitute a single molded case circuit breaker.

8. A circuit interrupter as claimed in claim 1, wherein said plurality of pole units are constituted of first and second 3-pole molded case circuit breakers and wherein said first half of said plurality of pole units includes two of the 3 pole units of said first 3-pole circuit breaker and one pole unit of said second 3-pole circuit breaker, and wherein the second half of said plurality of pole units includes the remaining two pole units of the second 3-pole circuit breaker and the remaining pole unit of said first 3-pole circuit breaker.

9. A circuit interrupter as claimed in claim 1, wherein all of the pole units are contained in first, second and third 2-pole molded case circuit breakers, and wherein said first half of said plurality of pole units includes one pole unit from each of said first, second and third 2-pole circuit breakers, and wherein said second half of said plurality of pole units includes the second pole unit from each of said first, second and third 2-pole circuit breakers.

10. A circuit interrupter as claimed in claim 1, wherein all of the said pole units are arranged in a side-by-side relationship and wherein each of said pole units includes a line terminal and a load terminal, and wherein said first and second supply line terminals are the outermost of said pole unit line terminals, and wherein said first and second load terminals are the innermost of said pole unit load terminals.

11. A circuit interrupter as claimed in claim 1, wherein said release means is responsive to either of said overcurrent sensing devices to open the circuit interrupter in the event of a fault between load-terminal and neutral.

12. A circuit interrupter as claimed in claim 1, further including a panel having first and second panel buses and plural branch circuit breakers connected to said panel buses, said circuit interrupter forming the main protection device of the panel with the first and second load terminals of said interrupter being connected to said first and second panel buses, respectively.

13. A circuit interrupter panel for a three-wire single phase 240-volt alternating supply, having an available current of the order of 100,000 amperes and including two oppositely phased line conductors and a neutral conductor, said circuit breaker panel including first and second molded-case 3-pole circuit breakers, jointly providing 6 pole units connected in two series circuits constituting a main two-pole circuit interrupter having two line terminals for said line conductors and two load terminals, a first panel bus and a second panel bus connected to said load terminals, respectively, and a plurality of branch breakers connected to said first and second panel buses, each said pole unit including an overcurrent sensing device and each said 3-pole breaker having quick-release means for all the poles thereof, each of said series circuits including 1 pole unit of each of said 3-pole circuit breakers and two pole units of the other of said 3-pole circuit breakers, said 3-pole breakers having a response time of less than about 4 milliseconds between instantaneous current overload and full opening of the contacts thereof.

14. A circuit breaker panel as claimed in claim 13, wherein each of said pole units has a movable contact mounted on a movable contact arm and wherein the length of said movable contact arm from pivot point to the remote end of the movable contact is less than about one and one-half inches.

15. A circuit protector for a 240-volt alternating current supply having plural line conductors and having an available current of the order of 100,000 amperes, said circuit protector including a plurality of coordinated molded case pole units comprising plural groups of three of said pole units connected in series between a load terminal and a line terminal and including one group for each said line conductor, respectively, each of said series-connected pole units including at least one overcurrent sensing means and each of said series-connected pole units having quick release means responsive to the overcurrent sensing means, thereof all of the pole units being coupled together for causing coordinated tripping thereof in response to a fault detected by any of said overcurrent responsive means, said coordinated pole units providing a current-limiting circuit interrupter capable of driving the fault current to zero without dependence on the source voltage decreasing to zero.

* * * * *